United States Patent [19]

Kent et al.

[11] 3,985,310

[45] Oct. 12, 1976

[54] METHOD FOR WINDING RING-SHAPED ARTICLES

[75] Inventors: Bryan Kent, Ithaca; Duane Kent, Vernon Center, both of N.Y.

[73] Assignee: Pulse Engineering Inc., San Diego, Calif.

[22] Filed: Oct. 7, 1974

[21] Appl. No.: 512,852

Related U.S. Application Data

[60] Continuation of Ser. No. 341,536, March 15, 1973, abandoned, which is a division of Ser. No. 120,960, March 4, 1971, abandoned.

[52] U.S. Cl. ..... 242/4 R

[51] Int. Cl.[2] ..... H01F 41/08

[58] Field of Search ..... 242/4 R, 4 A, 4 B, 4 BE, 242/7.03; 140/92.1, 88; 29/604, 605

[56] References Cited

UNITED STATES PATENTS

| | | | |
|---|---|---|---|
| 2,160,588 | 5/1939 | Granfield | 242/4 R |
| 2,221,687 | 11/1940 | Evans | 242/4 R |
| 2,263,972 | 11/1941 | Leoser | 242/4 B |
| 2,974,890 | 3/1961 | Davis | 242/4 B |
| 3,000,580 | 9/1961 | Matowich, Jr. | 242/4 A |
| 3,132,816 | 5/1964 | Oshima | 242/4 B |
| 3,191,878 | 6/1965 | Kitano | 242/4 R |

*Primary Examiner*—Billy S. Taylor
*Attorney, Agent, or Firm*—John A. Howson

[57] ABSTRACT

A method for winding wire strands onto toroidal cores in which a length of wire is fed along a radially inwardly facing channel in an arcular guide to form a loop. As the leading end of the wire completes this loop it hugs the channel's radial boundary to form a second loop radially inside the first as the wire feeding continues. A gap is provided in the radial boundary of the channel for receiving the core with the core's central aperture in this gap so as each loop is formed the wire in that loop passes through the core. The upper and lower boundaries of the channel are spaced apart so as to maintain the loops in a single concentric layer around the guide and through the core. When enough wire has been fed the feeding is stopped, but the movement of the loops around the guide continues and winds (tightens) at least one new turn of wire onto the core for every complete circulation of the loops around the guide. Two or more wires can be wound onto a core at the same time with the method according to the invention.

20 Claims, 24 Drawing Figures

METHOD FOR WINDING RING-SHAPED ARTICLES

This is a continuation of application Ser. No. 341,536, filed Mar. 15, 1973, now abandoned, the latter being a division of application Ser. No. 120,960, filed Mar. 4, 1971, now abandoned.

BACKGROUND OF THE INVENTION

This invention relates to methods for winding successive convolutions of one or more continuous strands of material on a selected workpiece. More particularly it concerns an improved method for winding strands of wire onto ring-shaped articles, such as for example, toroidal cores. As used herein the term "core" means a ring-shaped article having the plane closed curve cross section of a toroid, or any one of various other different cross sections. The term "wire" as used herein means any material in the form of a flexible strand which is not so supple that it buckles easily when pushed from one end in a lengthwise direction. The terms "continuous wire supply" and "continuous wire source" means that the length of continuous wire in the supply or source is sufficiently long to enable a plurality of cores to be wound from the supply or source before the wire is used up.

Wire wound cores are well-known products which have been used for many years in various kinds of electrical equipment. Perhaps most recently very small wire wound cores have been used as memory elements in computers. Heretofore the wire has usually been wound onto these cores through the use of a rotating winding ring or shuttle which carries several loops of wire and rotates at high speed through the central aperture of the core. In so doing it winds the wire tightly onto the core (see for example, U.S. Pat. No. 2,810,530). More recently efforts have been made to accomplish this winding without inserting a shuttle or any element other than the wire through the central aperture of the core (see for example, U.S. Pat. No. 3,132,816). None of these devices and methods, however, are entirely satisfactory and some of them are quite complex.

It is therefore one object of this invention to provide an improved shuttleless method for winding cores with wire.

Another object is to provide a method for winding cores with wire which is simpler, more efficient and more accurate than many prior art methods and devices.

A further object is to provide a method having the above characteristics with an improved ability to count and control the precise number of turns of wire that are wound onto the core.

Still another object is to provide an improved method for providing cores with bifilar and multifilar windings.

Further, other and additional objects and advantages of the invention will become apparent from the summary, detailed description of the drawings and claims which follow hereinafter.

SUMMARY OF THE INVENTION

In one aspect, the method according to the invention comprises a method of winding a core with a length of wire having a free end from a continuous wire supply including the steps of forming the length into a coil of wire having an axis and a plurality of generally radial circular loops through the core's opening by repeatedly circulating the wire's free end through the core's opening about the coil's axis while feeding wire from the supply from a point radially inwardly of the loops in the coil and thereafter when a coil of desired length has been formed through the core winding the length onto the core by halting the feeding of wire from the remaining wire supply while continuing to circulate the coil and the free end in the coil about the coil's axis through the core's opening until the desired number of turns have been wound on. The turns are formed at the rate of not less than one turn for each complete circulation or revolution of the coil.

The loops are formed using apparatus which includes a generally circular guide having a radially inwardly facing channel along which the wire is advanced and by which it is guided into a circular loop. There is a gap in the radial boundary of the channel for receiving the core so that its central aperture lies in this gap. The core's aperture extends inwardly from the radial boundary far enough to enable as many loops as are required for winding the core to fit within the aperture in a single radially extending layer. The upper and lower boundaries of the channel are spaced one above the other a distance of less than two wire diameters (preferably between about 1.25–1.4 diameters) so that the loops are maintained in a single layer.

The wire is fed lengthwise into the channel through one or more wire feeding tubes positioned radially inwardly of the channel. The ends of the tubes closest to the channel are curved a predetermined amount so that as the wire is fed toward the channel it is precurved to a radial curvature which is just less than that of the channel itself. This insures that the wire will hug the radial boundary of the channel as it moves around it and facilitates the formation of the loops. Mounted in one or more additional gaps in the channel are pairs of circulating rollers which frictionally engage each other in a plane through the middle of the channel. One of the rollers in each pair is driven in a predetermined direction so that as the wire passes between the two rollers in that pair it is gripped by them and advanced around the channel. When two roller pairs are used each one advances the wire around the channel to the next one.

As the wire passes through and beyond each feeding tube its nose or leading end contacts the upper and radial boundaries of the channel which together with the lower boundary guides it through the central aperture of the core and between the circulating rollers. As the feeding continues, these rollers advance the nose of the wire around the channel past the point of beginning to complete the first loop. As the leading end of the wire completes this loop it hugs the radial boundary of the channel and squeezes between the loop just formed and the channel's radial boundary. In this way a second loop begins inside the first. It has a diameter that is smaller than that of the first loop (outer loop) by an amount equal to two wire diameters. During feeding each loop in the coil moves around the channel together at the same angular velocity. As the nose of the wire passes through the core's aperture a second time and between the two circulating rollers radially outwardly of the second loop it still hugs the channel's radial boundary and a third loop begins to form radially inwardly of the second. This process continues until the desired length of wire has been fed and the required number of loops formed. Each new loop is laid inside the others already formed as the nose of the wire travels around the channel.

When enough wire has been formed into loops the feeding of the wire stops, but the circulation of the loops around the channel continues. When this occurs the innermost loop is peeled radially inwardly away from the other loops and out from between the circulating rollers and from the channel and is tightened into a turn around the core. One new turn of wire is tightened onto the core for every complete circulation of the loops. A wire release member adjacent the circulating rollers facilitates removal of the inner loop from between the rollers before each turn is tightened onto the core and prevents the remaining loops from disengaging from the rollers prematurely.

After a predetermined number of revolutions of the coil the first inner loop will have formed several turns on the core and have been used up. Then the next inner loop will peel away from the remaining ones and be wound onto the core in the same manner. When all the loops have been wound onto the core, the winding stops, the wire is cut and the wound core removed. Then a new one is put in its place and the process is begun again.

In one preferred embodiment the apparatus includes a mechanism for slowly rotating the core as the loops circulate so that each turn is wound on at a point adjacent the last turn rather than on top of that turn. Means are also provided for cutting the anchored end of the inner loop of wire after the first turn is wound on the core so as to free the wire on the core from its source. In this way the core is free to be rotated to accommodate new turns.

Another aspect of the invention includes a method for winding a core with two or more different wires simultaneously so that each turn on the core is formed from a different wire than the previous one. If two wires are used, this means that every other turn on the core is formed from the same wire. If three or more wires are used, the turns are formed in order from wires 1, 2 & 3, 1, 2 & 3 and so forth. When a bifilar (two wire) winding is desired the basic winding method of the invention just described is followed except that after the first wire has been fed part way around the channel, the second one is fed between the first wire and the radial periphery of the channel. The noses of these wires are staggered one behind the other to prevent their getting tangled up with each other before they enter the channel. If a trifilar winding is desired, each wire would be fed between the previous one and the guide channel, and its nose would be staggered with respect to the noses of the other wires. When two or more wires are simultaneously wound on a core using the method of this invention, regardless of how far apart their noses are staggered it is also important to stagger the times at which the feeding of each wire is stopped. The wire forming the radially innermost loop must be stopped first and those forming loops radially outwardly of it next, each in turn to ensure that the inner loop will peel away from the others in order. This helps ensure that each wire will be wound without crossing over the others and getting mixed up.

Further, other and additional aspects of the invention will become apparent from the drawings, the detailed description and the claims.

DETAILED DESCRIPTION OF THE DRAWINGS

Figure 1:
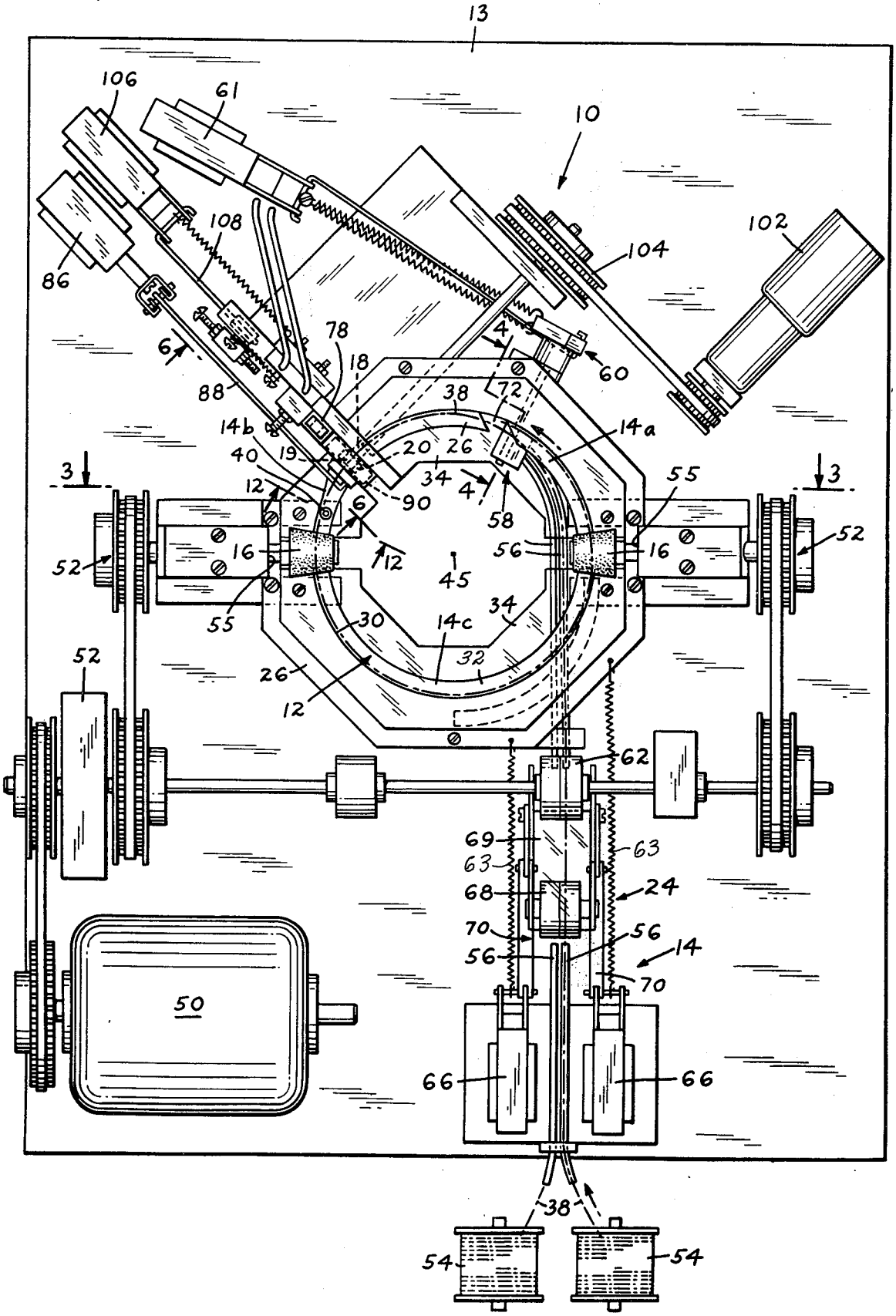
FIG. 1 is a plan view of one preferred embodiment of apparatus according to the invention.

Referring now to FIGS. 1–4 of the drawings, one preferred embodiment of an apparatus for carrying out the inventive method comprises a core winding mechanism 10 mounted above a base 13 by a plurality of columnar supports 15. The mechanism itself includes a wire guide 12, a wire feeding device 14 and two pairs of circulating rollers 16 for advancing the wire 38 around the guide to form a number of radial wire loops in a single layer through the central aperture 19 of a core 20.

The guide 12 includes a radially inwardly facing annular channel 22, the lower boundary 27 of which is defined by a radially inwardly extending aluminum lip 26. The upper boundary 32 of the channel 22 is defined by a second radially inwardly extending clear Lucite lip 34 spaced above the lower lip 26 and its radial boundary 30 is defined by a brass wall 28 extending vertically between the two lips. Other suitable materials may also be used to form the guide channel if desired. It is important, however, that the radial boundary of the channel be wear-resistant, smooth (i.e., free of nicks and ledges) and slippery so as not to provide substantial frictional resistance to the passing of the wire around the channel.

The height of the channel 22 in the distance between its upper and lower boundaries 32, 27 and is between one and two diameters of the wire which is to be wound on the core. Preferably this height is between about 1.25 to 1.4 wire diameters because if it gets too large as compared to the the diameter of the wire the inner loops may have a tendency to jam between the channel and the outer loops.

In the preferred embodiment now being described there are three gaps spaced apart circumferentially in the guide 12. One of these gaps provides a space 18 for insertion of the coil 20 which is to be wound. The other two provide spaces for the two pairs of circulating rollers 16 which are positioned 180° apart in the guide. The guide 12 is actually made in three sections 14*a*, 14*b*, 14*c* with the spaces between them defining the gaps. One of the sections (14*a*) lies between one roller pair and the core 20, another (14*b*) between the core 20 and the second roller pair and the third (14*c*) between the two roller pairs. The wall portion 28 of the section 14b adjacent the core is rounded slightly in a radially outward direction (not shown) beyond the cylindrical plane containing the guide's radial boundary 30 to guide the nose or leading end of the wire back into the cylindrical path of movement of the channel in the event that it moves tangentially (i.e., radially outwardly) across the gap 18 containing the core while it is unsupported. Tendencies toward such radial movement have been found to occur when the wire is fed into or circulated about the guide at speeds of between 2000 to 3000 feet per minute (f.p.m.). Slight rounding of the wall adjacent the gaps in which the roller pairs are positioned is also desirable though not essential.

The rollers 16 in each pair are covered with a resilient frictional surface such as, for example, rubber or other equivalent material for gripping the wire and advancing it around the channel. The junction line between the peripheries of the rollers 16 in each pair lies in a plane through the middle of the channel 22 for this purpose. All the rollers 16 are journaled in bearings 55 in supports 15 above the base 13 and one roller 16 in each pair is rotated (i.e., driven) at constant speed by a motor 50 through a drive linkage 52 while the other roller 16 is rotated by its frictional contact with the driven roller in its pair.

Figure 2:
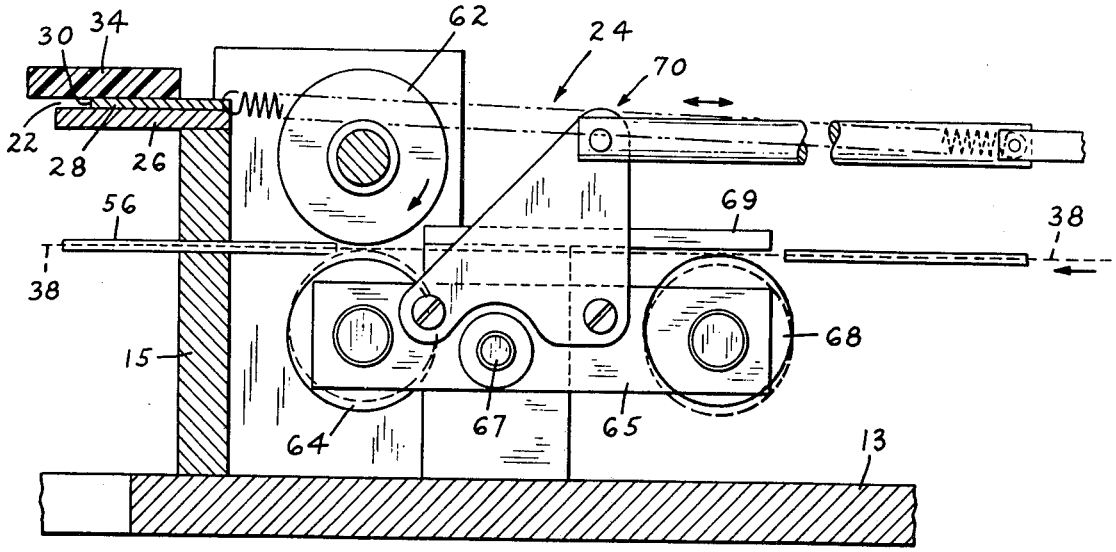
FIG. 2 is an elevation view of a portion of the wire feed mechanism portion of the preferred embodiment taken generally on line 2—2 of FIG. 1.
Figure 5:
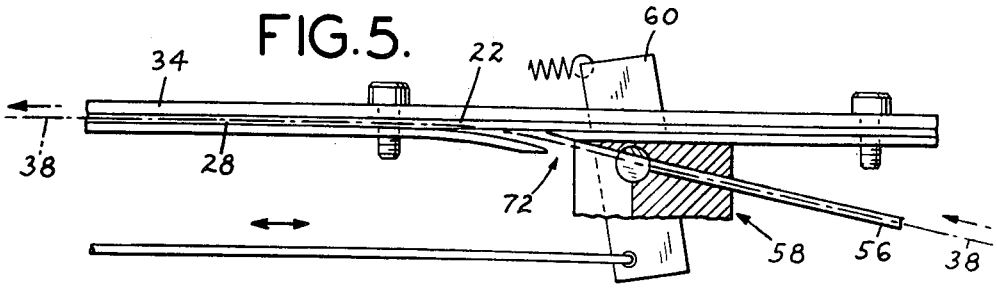
FIG. 5 is a partial cross section view in elevation of the cutting apparatus of FIG. 4 taken on line 5—5 of that figure.
Figure 6:
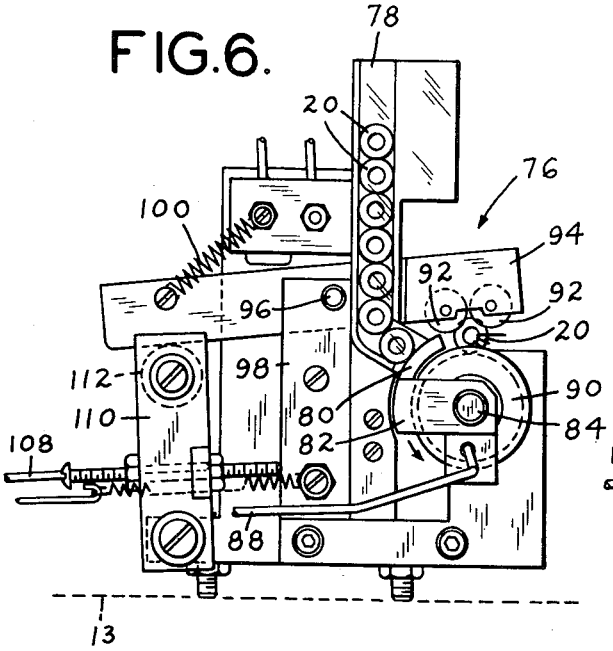
FIG. 6 is an elevation view of the core feeding portion of the preferred embodiment showing the relationship of the parts as the winding of a core is completed. It is taken generally along line 6—6 of FIG. 1.
Figure 7:
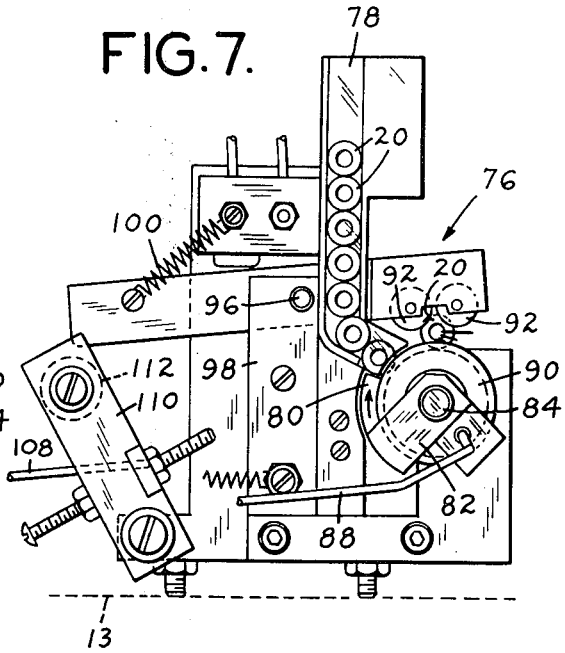
FIG. 7 is a schematic view in elevation of the core feeding apparatus just prior to ejection of a wound core and insertion of a new core prior to winding.

Referring now to FIGS. 1, 2 & 5, the wire feeding device 14 includes a pair of tubes 56 through which the wire 38 is fed into the channel 22 and a separate feeding mechanism 24 for each tube comprising a, a pivotally mounted idler roller 64, and a stop roller 68. A driven roller 62 and a stop plate 69 are common to both mechanisms. The wire 38 comes from a pair of sources 54 and passes through the feeding mechanism and the tubes into the channel 22. In each feeding mechanism 24 the idler and stop rollers 64, 68 are mounted on a bar 65 which is pivotally mounted on one of the supports 15, via a shaft 67 through the bar, at a point between the two rollers. A solenoid 66 is connected to the bar 65 through a linkage 70 so that when the solenoid is energized the bar is pivoted in one direction (dashed lines in FIG. 2) until the idler roller 64 engages the driven roller 62. When the solenoid is deenergized the stop roller 68 engages the stop plate 69. The wire is guided between both the driven and idler rollers 62, 64 as well as between the stop plate 68 and stop roller 69 so that when the solenoid is energized frictional engagement between the driven and idler rollers feeds the wire 38 through the tube into the channel 22. When the solenoid is deenergized friction between the stop roller 68 and stop plate 69 prevents the wire 38 from being fed into the channel. As is illustrated in dashed lines in FIG. 2 there is a tension spring 63 connected to the solenoid 66 for spring returning it to its wire holding or braking position when the solenoid is deenergized.

The feeding tubes 56 are spaced apart from each other but mounted side by side below the channel. Each tube is inclined so as to direct the wire 38 upwardly through the aperture 72 in the lip directly into the channel 22 itself. In addition, each of these tubes is curved slightly adjacent this end so as to impart a precurvature to the wire 38 which is just slightly less than the curvature of the guide channel 22 itself. Also, adjacent this end of each tube 56 is a shear-action wire cutting device 58 operated through a linkage 60 by a spring returned solenoid 61 which enables the operator of the coil winder to cut the wire at the end of the tubes whenever desired. This cutter is designed to leave the nose of the wire unbent and relatively burr free.

Figure 12:
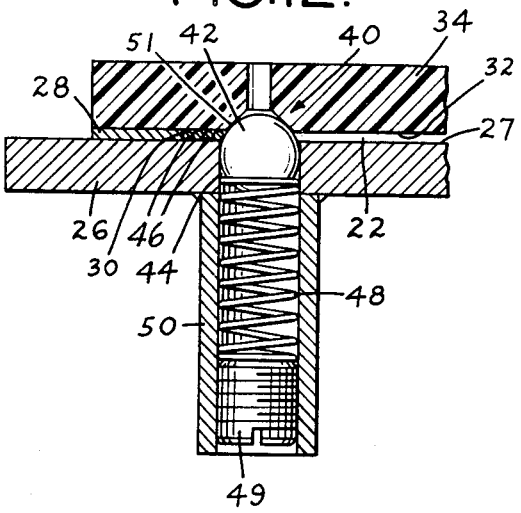
FIG. 12 is a partial cross section view in elevation of the wire release ball portion of the preferred embodiment taken on line 12—12 of FIG. 1.

Referring now to FIGS. 1 and 12, in the guide segment 14(*b*) adjacent the pair of rollers 16 there is a spring biased wire release device 40 which includes a ball bearing 42 mounted in an aperture 44 in the lip 26 a distance radially inwardly of the radial boundary 30 of the channel 22. This distance is sufficient to accommodate the desired number of loops 46. Sections of wire 46 are shown in FIG. 12 side by side in a single layer between the radial boundary 30 of the channel and the ball 42. In the preferred embodiment the ball 42 is biased upwardly against the Lucite lip 34 by a compression spring 48, the force of which is adjustable by means of a rotatable screw 49 in a housing 50. If desired, the ball 42 may be mounted in the lucite and biased downwardly in the reverse direction. The spring 48 seats the ball 42 in a slight upwardly extending depression 51 in the Lucite lip 34. The diameter of the ball is sized to be greater than the height of the channel 22 so that any contact between the wire and the ball will be above the middle of the ball. This way the sloping surface of the ball will cause the wire to slide upwardly over the ball creating a sufficient downward thrust on it when the wire is pulled tight to depress the ball and allow the wire to slide over it. The force necessary to depress the ball is adjustable according to the setting of the screw 49. Preferably, the upper third of the ball lies above the lower boundary 27 of the channel 22. The ball may be made of hardened polished steel or any other satisfactory material that resists wear and is relatively slippery and free of nicks and ledges which might prevent the wire from sliding over it.

The diameter of the channel 22 may be from between about 1 inch to 9 inches or more depending on the application for which the device is intended. A 9 inch diameter channel will handle the vast majority of applications requiring a large number of turns on the core while a 1 inch diameter channel will handle most small diameter wire windings when less than 100 turns, or so, on a core are required.

The number of turns that can be wound on a given core 20 using the device according to this invention depends not only on the diameter of the core aperture, but on the wire diameter, the diameter of the channel 22 and the radial distance between the ball 42 and the radial boundary of the channel. The smaller the wire diameter is and the larger the other dimensions are, the more turns can be wound on a core of given cross section.

Figure 3:
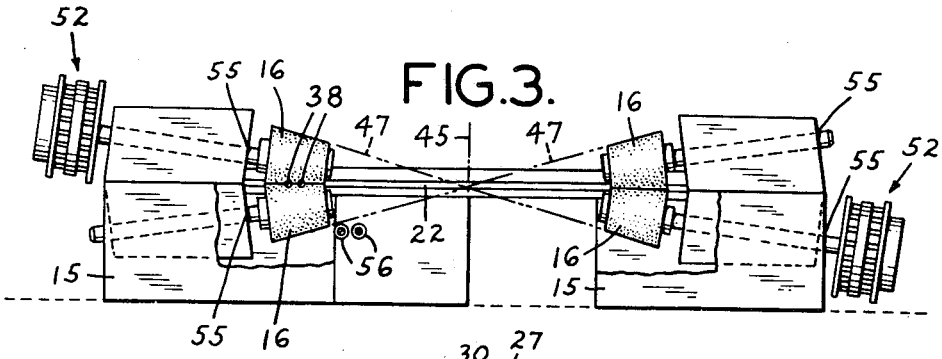
FIG. 3 is a view in elevation of the circulating roller portion of the preferred embodiment taken generally on line 3—3 of FIG. 1.
Figure 4:
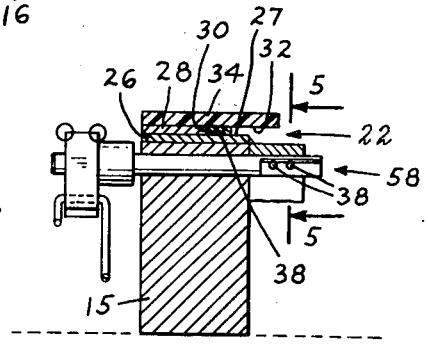
FIG. 4 is an elevation view of the wire cutting portion of the preferred embodiment shown partially in cross section and taken on line 4—4 of FIG. 1.

As illustrated in FIG. 3, the rollers 16 are beveled to control the speed of the wire and loops around the channel. For example, it is important to ensure that each wire loop 46 is driven around the channel 22 at an angular velocity which is equal to or greater than that of any loop radially outwardly of it. This is so because each loop has a smaller diameter than the ones radially outwardly from it. If the angular velocity of any inner loop were less than that of any outer loop the inner loops would circulate around the guide more slowly and would get larger and jam against the outer ones preventing the device from working properly. To avoid this result the rollers in each pair are not cylindrical but are beveled and set at an angle to each other so that their lines of contact lie in the middle of the channel 22. When rays 47 containing the opposite sides of each roller intersect at a point at or short of the central axis 45 of the channel the bevel on the rollers is proper to ensure that no jamming problems will result when more than two loops are required to do the winding. Cylindrical rollers can probably be used without this jamming when only two loops are built up in the channel prior to winding.

Figure 14:
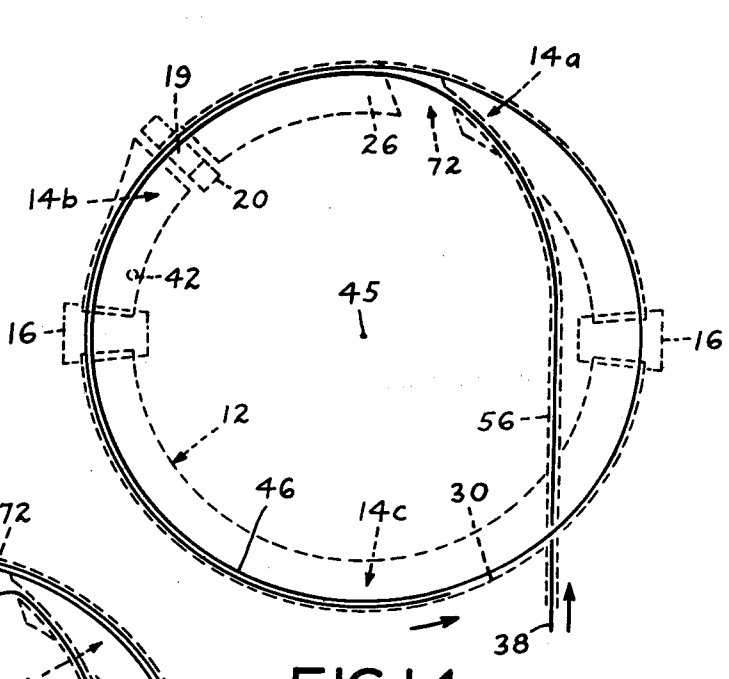
FIG. 14 is an enlarged schematic plan view similar to FIG. 13 showing the feeding step of the preferred method as half of the second loop is formed.
Figure 13:
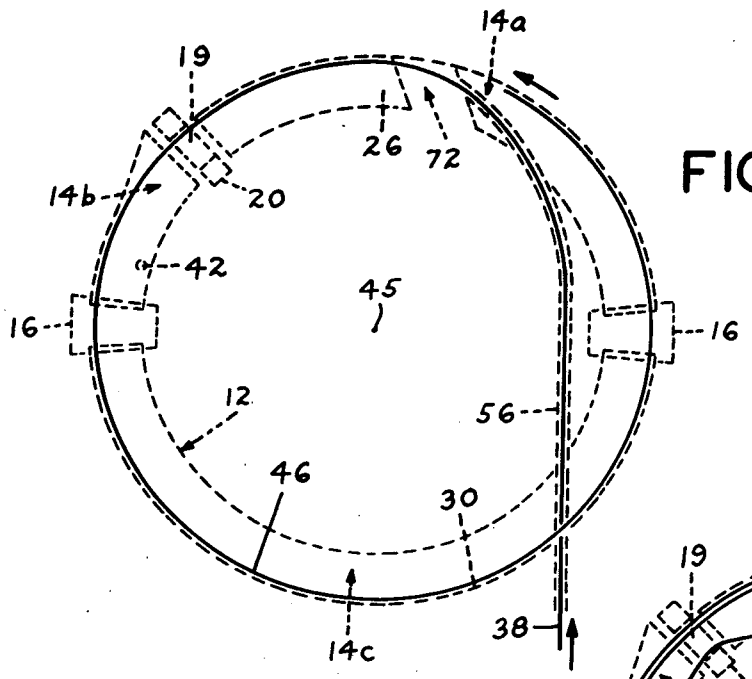
FIG. 13 is a schematic plan view of an enlarged portion of the apparatus of FIG. 1 illustrating a portion of the wire feeding step of the preferred method of the invention in which the first loop is almost completed.
Figure 15:
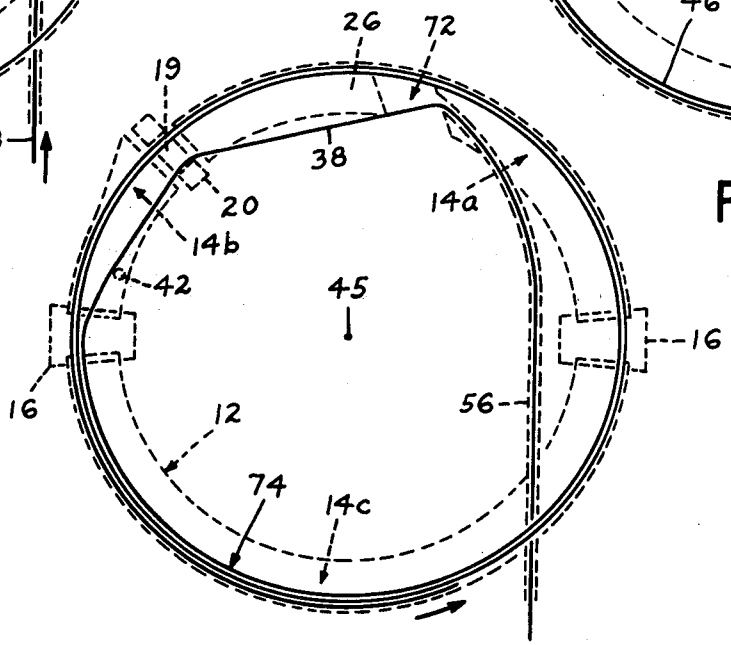
FIG. 15 is an enlarged schematic plan view similar to FIG. 13 illustrating the preferred winding method of the invention just after the wire feeding step has stopped and the winding is begun.
Figure 17:
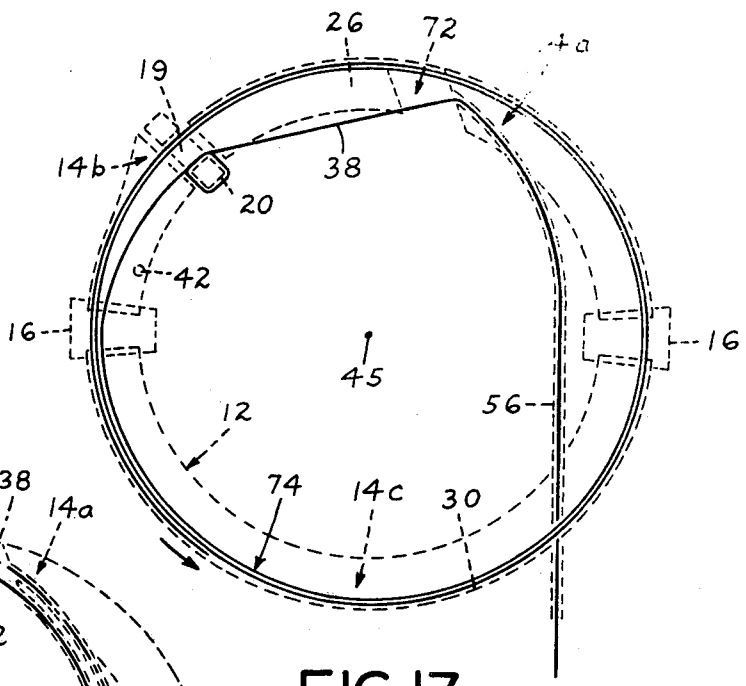
FIG. 17 is an enlarged schematic plan view similar to FIG. 16 just after the first wire turn is formed on the core and the inner loop is about to be peeled away from the channel again.
Figure 16:
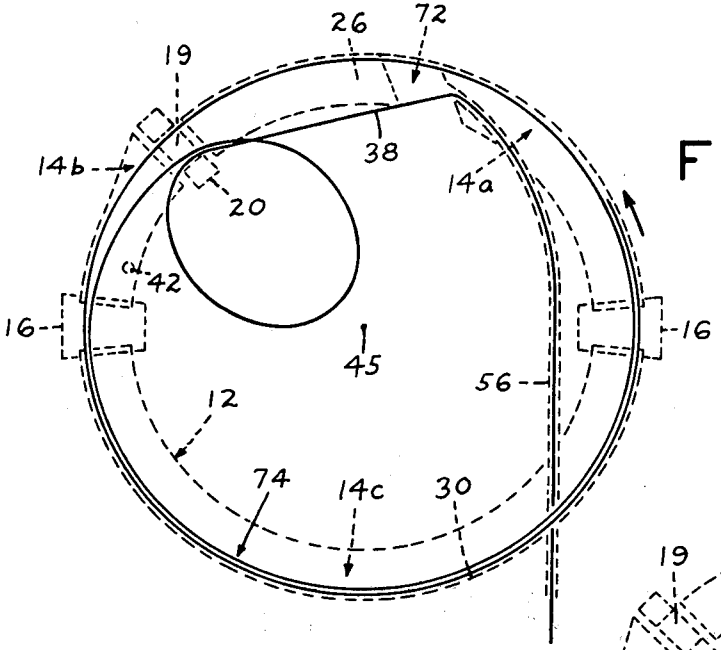
FIG. 16 is an enlarged schematic plan view similar to FIG. 15 showing the winding method of the invention after the inner loop has been pulled out of the channel.

Referring now more particularly to FIGS. 1, 2, 13–17 of the drawings, in operation when a core is to be wound with a single wire the coil winding mechanism 10 feeds the leading end of the wire 38 through one of the tubes 56 by means of the driven and idler rollers 62, 64 whenever one of the solenoids 66 is energized. As the feeding continues, the wire 38 is precurved in the tube 56 and passes from a point below and inwardly of the channel 22 up through the aperture 72 in the lower lip 26 of the channel 22 against the radial and upper boundaries 30, 32. From there it slides along the radial boundary 30 of the channel 22 through the central aperture 19 of the core 20, radially outwardly of the ball 42 and between the second set of circulating rollers 16 which grip the wire and advance it around the channel to the first set of circulating rollers 16 at the end of segment 14c of the device. There the wire is gripped and advanced again by the set of rollers 16 which continue circulating the wire around the channel with the wire and its leading end hugging the channel's radial boundary 30 as illustrated in FIG. 13. The feeding continues with the leading end of the wire hugging the radial boundary 30 of the channel 22 and passing radially outwardly of each additional loop as it is formed. With each revolution the nose passes through the core, radially outwardly of the ball 42 and between the circulating rollers 16 at the end of wire feeding segment 14b as illustrated in FIG. 14. As soon as the desired number of loops have been formed the solenoid 66 is deenergized causing the idler roller 64 to move away from the driven roller 62 and the stop roller 68 to be spring driven into engagement with the stop plate 69 so that the wire 38 from the source 54 is squeezed between them and prevented from moving through the tube 56. This anchors the inner loop of the coil 74 of loops at the end of the feeding tube. Winding of the wire 38 onto the core 20 begins immediately as the circulating rollers 16 continue to rotate the loops 46 of wire around the channel without stopping. Since the innermost loop is now anchored at its inner end the circulating rollers 16 adjacent the end of segment **14*b* of the device pull that section of the wire between the tube 56 and the rollers tight as illustrated in FIG. 15. Operation of the other pair of circulating rollers between segments 14a and 14c continues advancing all the loops around the channel. When the circulating rollers have pulled the inner loop sufficiently taut it contacts the ball 42 in the wire release device 40 and depresses it sufficiently against the force of the spring 48 so that the wire slides over the top of the ball and radially inwardly from the channel 22 as illustrated in FIG. 16. Because the leading end of this inner loop is integral with the loops radially outwardly of it continued rotation of the circulating rollers tightens the loop on the core as illustrated in FIG. 17.**

Continued operation of the circulating rollers 16 after one turn has been wound onto the core causes the inner loop in the coil to again be tightened, slid passed the wire release device 40 and out from between the circulating rollers to form a second turn on the core and this process occurs again and again until a sufficient number of turns have been wound onto the core or wire or all the loops have been used up, whichever occurs first.

Operation of the wire cutting device 58 may be accomplished at any time after the first turn has been wound onto the core and serves to sever the wire being wound from the source 54 and ready the mechanism for winding the next core. It is particularly advantageous to sever this wire after a single turn has been formed on the core because the existence of one turn sufficiently anchors the wire on the core so that the anchoring function of the wire feeding device is no longer necessary. Severing the wire at this point permits the core to be rotated slowly as hereinafter described to form each turn adjacent the previous one on a core rather than on top if it. In addition, cutting the wire between the feeding device and the circulating rollers avoids the necessity for stopping the core winding mechanism and loading it with a new batch of wire before the winding operation can begin again as is required in virtually all shuttle type core winders.

In this device the speed at which the wire may be fed into the channel and wound onto the core is determined by the stiffness of the wire and the friction which is generated between it and the upper, lower and radial boundaries 27, 32, 30 of the channel 20. The friction generated is created in part by precurving the wire to a slightly larger diameter than the channel and is increased by the centripetal force on the wire which occurs at high feeding speeds such as between 2,000 to 3,000 feet per minute. In a 2½ inch diameter channel No. 28 gauge of wire has satisfactorily been passed through a 0.045 inch diameter tube and wound onto a core at a speed of 50 feet per second (i.e., 3,000 feet per minute). The amount of time it takes to accelerate the wire to this speed is minimal because the inertial resistance to acceleration is attributable only to the inertia of the wire itself and not to any additional mass of material, such as a shuttle. Also, since the feeding occurs at the same rate as the circulation of the wire around the channel, the winding begins the instant the feeding stops and there is no time lag during any acceleration of any parts of the mechanism between the feeding and winding. Similarly, the winding is completed at the same speed it began without any deceleration of the circulating rollers 16. A real advantage of the device therefore is that these rollers can and do operate at a constant speed whenever the core winding mechanism 10 is turned on.

Referring now more particularly to FIGS. 1 & 6–10 of the drawings, the device for feeding cores into the aperture 18 and for rotating them as the winding occurs will now be described. The core feeding device 76 includes a vertically oriented chute 78 which contains a supply of cores 20 which are urged downwardly by gravity against the radially outer surface 80 of an arcuate arm 82 which is rotationally mounted about a shaft 84 so that it can be moved in opposite directions about the shaft to feed one core after another into the gap 18.

The device for operating this arm which acts as a kind of plunger includes a solenoid 86 and a linkage 88 which is connected to one end of the arm for rotating the arm a predetermined number of degrees in a selected direction about the shaft 84 whenever the solenoid is energized or deenergized.

The means for rotating a core in the gap 18 includes a driven roller 90 and a pair of spaced apart idler rollers 92 journaled above it in a rocker arm 94. The rocker arm 94 is pivotally mounted about a shaft 96 adjacent the upper end of a support 98 mounted on the base 13. A tension spring 100 connected between the opposite end of the arm 94 and a vertical extension of the support 98 constantly urges the arm clockwise, as indicated in FIGS. 6–10, so as to provide a three point support between the two idler rollers 92 and the driven roller 90 for maintaining a core 20 in its proper position in the gap 18. Each of these rollers is grooved as indicated in FIG. 10 to prevent the core from unintentionally slipping out from between them. The driven roller 90 is rotated at a selected speed by a motor 102 through a conventional linkage 104 and because the core is mounted on this roller the frictional contact between them causes the core to rotate at the speed of the driven roller whenever the two are in contact with one another.

In operation when the winding of a core 20 has been completed and a fresh core is required the arm 82 is moved a distance counterclockwise by energization of the solenoid 86 through linkage 88. This permits a fresh core to move downwardly through the chute 78 to a position in front of the arm (see FIGS. 6 & 7). Simultaneously a second solenoid 106 is energized to unlock the rocker arm 94 so that a fresh core 20 can be inserted between the driven and idler rollers 90, 92. This is accomplished by a linkage 108 which connects the solenoid 106 with a pivotally mounted arm 110 having a locking member 112 protruding from it under the end of the rocker arm 94 to which the tension spring 100 is attached. Energization of the solenoid 106 pivots this locking member away so that the arm 94 is free to oscillate a distance about the shaft 96 under the combined influence of the spring 100 and the cores 20 as they are inserted and removed from between the rollers 90, 92 (see FIG. 7).

Figure 8:
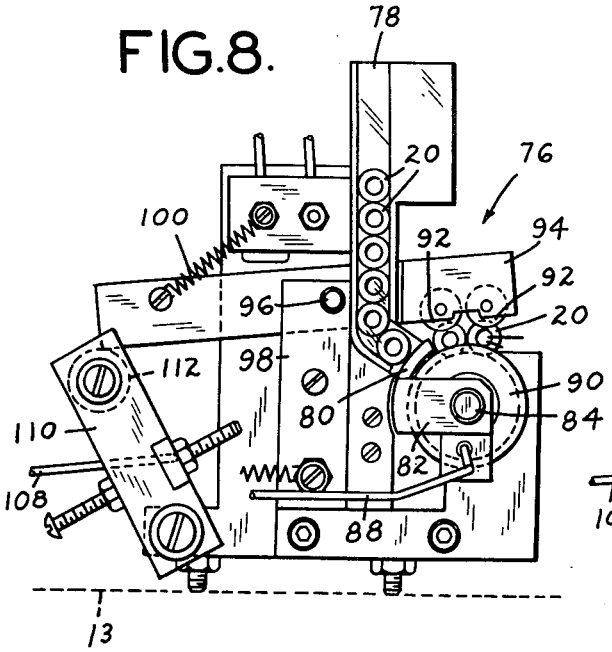
FIG. 8 is a schematic view in elevation of the apparatus of FIG. 7 during insertion of a new core.
Figure 9:
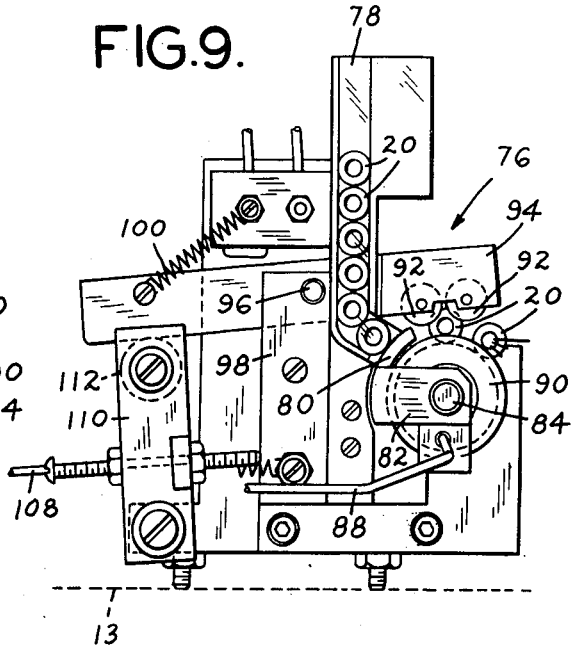
FIG. 9 is a schematic view in elevation of the FIG. 7 apparatus showing the new core fully seated and ready for winding to begin. The wound core is shown ejected from the apparatus.
Figure 10:
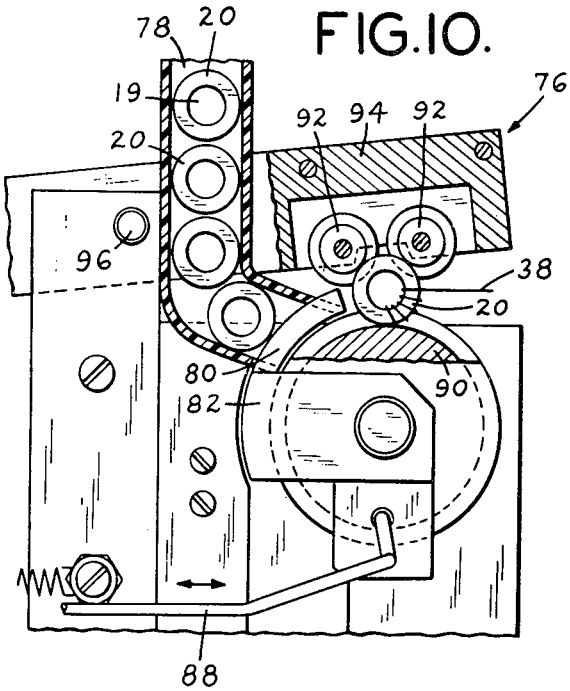
FIG. 10 is a blown-up schematic view in elevation of the apparatus of FIG. 6 with additional details of part of the core rotating portion of the apparatus shown.

As soon as the arm 94 is unlocked the solenoid 86 is deenergized and the arcuate arm 80 is spring returned to its original position pushing the fresh core in front of it into position between the rollers 90, 92, thus forcing the wound core out from between these rollers so it can fall away from the device without restraint (see FIGS. 8 & 9). Then the solenoid 106 is deenergized and spring returned to its original position in which the pivotally mounted arm 110 moves forward again bringing locking member 112 with it to a position underneath the rocker arm 94. This prevents the arm 94 from being moved counterclockwise about the shaft 96. The locking member 112 is adjustable in a vertical direction on the arm 110 so that its proper locking position can be set and changed as needed to hold the core between the rollers 90, 92.

Figure 11A:
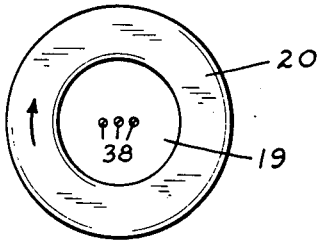
FIG. 11A–11D are schematic views in elevation illustrating the monofilar winding of a core and how the core rotates to place each turn adjacent the prior one.
Figure 11B:
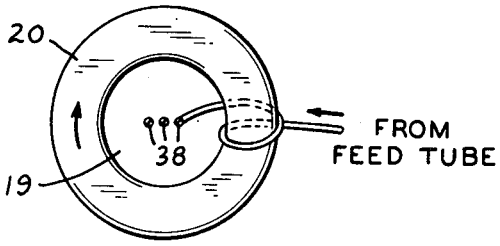
Figure 11C:
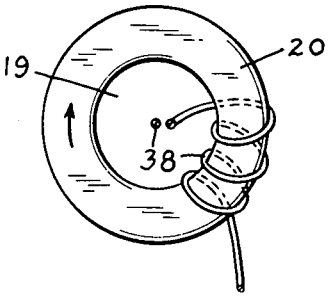
Figure 11D:
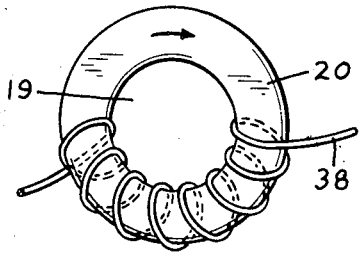

Referring now to FIGS. 11A, 11B, 11C & 11D, the effect of rotating the core during winding is clearly seen. Each turn wound onto the core is wound adjacent the previous turn due to the core's rotation. As illustrated in these figures three loops of wire 38 have been formed in the channel 22 (not shown) and passed through the aperture 19 in the core 20 while the core is rotated clockwise as shown by the arrow in the figures. After the first turn has been wound onto the core as seen in FIG. 11B additional turns will be wound on adjacent sections of the core due to the core's continuing clockwise rotation as seen in FIG. 11C. Thus, when the core has been fully advanced as illustrated in FIG. 11D each of the turns of wire will be wound around a different section of the core and none of them will be on top of one another.

Figure 18:
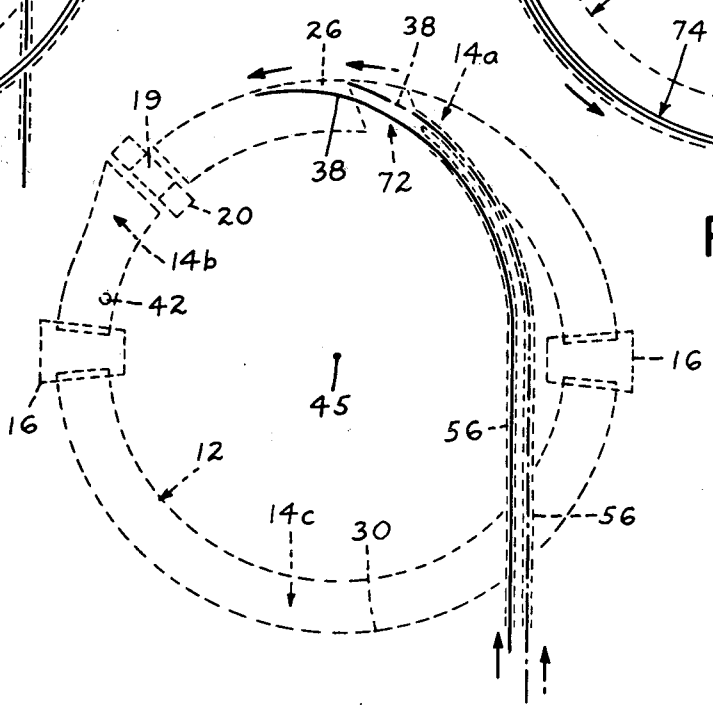
FIG. 18 is an enlarged schematic plan view of a stage in the preferred bifilar winding method according to the invention in which both wires are simultaneously fed into the channel one ahead of the other.
Figure 19:
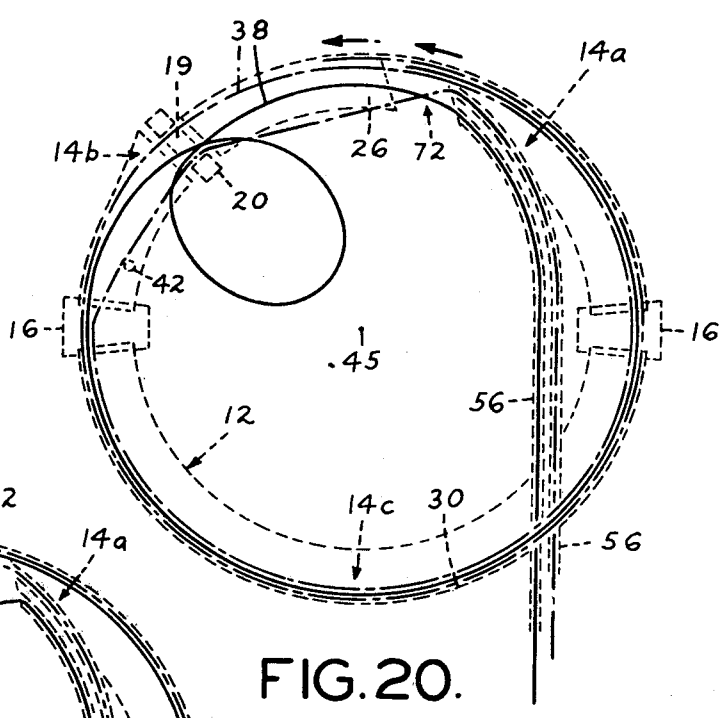
FIG. 19 is an enlarged schematic plan view similar to FIG. 18 just after the feeding of the radially inner wire is stopped.
Figure 20:
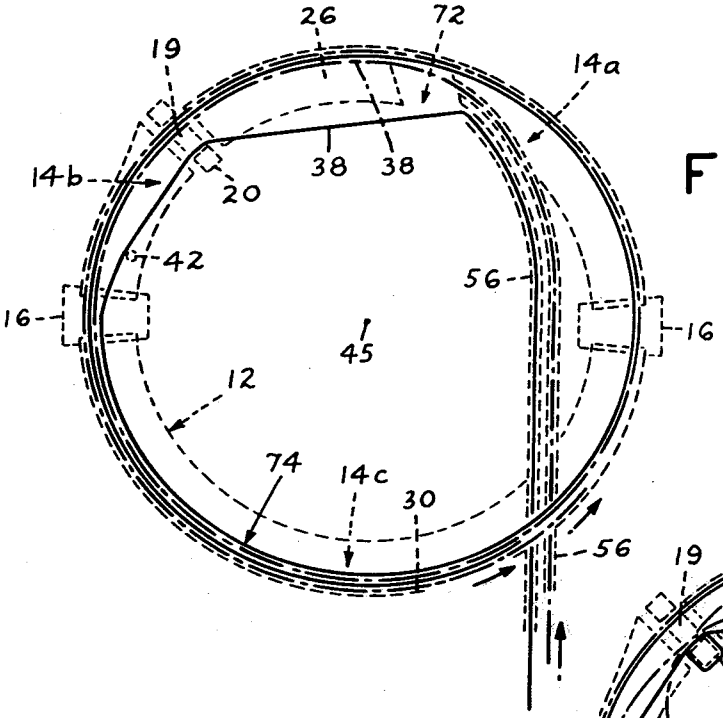
FIG. 20 is an enlarged schematic plan view similar to FIG. 19 as the winding of the inner wire continues and just after the feeding of the other wire has stopped.
Figure 21:
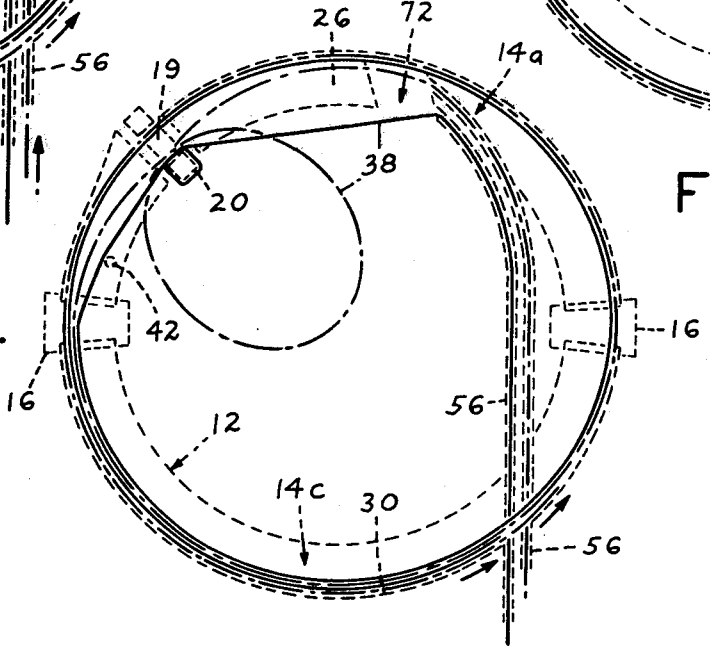
FIG. 21 is an enlarged schematic plan view similar to FIG. 20 just after the first inner wire turn is tightened onto the core.

Referring now to FIGS. 18–21, the preferred method of simultaneously winding a core 20 with two different wires, often called bifilar winding, will be described. In this method both wire feeding devices 14 in the preferred apparatus according to the invention are used so that different wires are fed through each of the tubes 56. The radially outer tube carrying one wire represented by dashed lines while its adjacent tube carries the other wire represented by a solid line. As seen in FIG. 18 the wire from the radially inner tube 56 is fed into the channel 22 first and is followed soon thereafter by the second wire which squeezes between the first wire and the radial boundary 30 of the channel. As the feeding continues, both wires pass through the core's aperture 19 past the wire release ball 42 and between one of the two pairs of rollers 16 which grip both wires and advance them around the channel to the other rollers 16. There the wires are again gripped and advanced side by side around the radial boundary of the channel to complete the first two-wire loop. Thereafter both wires squeeze between the just formed double loop and the radial boundary of the channel and continue around the channel as the continue feeding of the wires forms a second double loop through the core 20 radially inwardly of the first. When a sufficient number of double loops have been formed in the channel, feeding of the radially innermost loop (the last one to be formed), represented by the solid line in FIG. 19, is stopped. This causes that loop to tighten as illustrated in FIG. 19 and peel radially inwardly, away from the other loops past the wire release ball 42, as the wires continue to circulate around the channel (see FIG. 20). At about the time this inner loop becomes halfway tightened into a turn around the core feeding of the other wire stops and its inner loop tightens against the wire release ball 42 as illustrated in FIG. 20. Further operation of the rollers 16 advances the double wire loops further around the channel causing the first inner loop to be tightened into a turn around the core and the second inner loop to be tightened approximately halfway onto the core. At this point as seen in FIG. 21 the first wire having already completed a turn around the core the wire is anchored about the core and tightened again against the ball 42 prior to peeling away from the radially outer wire loops a second time. By the time this first wire has its second turn half tightened around the core the second wire's first turn will be completely tightened down and a second turn begun to be peeled away from the radially outer loops. The loops are tightened into turns on the core one after the other with each succeeding turn being formed from a different one of the two wires.

To facilitate having these turns alternate first one wire and then the next, it is preferred to stop the feeding of the wire in the radially outermost tube after the feeding of the wire in the innermost tube has stopped and after the rollers 16 have advanced the loops around the channel between about 45° to 315°. In this way the tightening of the loops onto the core will be separated sufficiently so as to ensure that each wire pulls away from the outer loops at an appropriate time and so that it does not pull an adjacent wire loop with it. As illustrated in FIGS. 18–21 with a bifilar winding method it is preferred to stop the feeding of the outer wire when the rollers have advanced the loops about 180° after the feeding of the inner wire has stopped. In fact, in any multifilar winding whether it be two, three or more wires as long as the feeding of each of the wires is stopped so that the loops advance at least 45° around the channel between the time the feeding of one wire is stopped and the feeding of the next is halted there is likely to be sufficient sepraration between the loops as they tighten down onto the core to wind properly without interference with one another.

After the first turn is formed in each loop it is preferred to cut that wire free of its source 54 so that the mechanism for rotating the coil can operate freely as the winding continues. When the winding is completed each core maybe moved out of the gap 18 and a fresh core inserted irrespective of whether the winding performed is one using two or more wires or only one.

While the invention has been described in detail in connection with monofilament and bifilar winding as indicated herein the winding techniques are also applicable to a three or more filament winding in which each turn on the core is formed from a different wire. It will be obvious to those skilled in the art that various modifications, changes and alterations in the design of the apparatus or steps of the method herein disclosed may be made within the spirit and scope of the invention.

What is claimed is:

1. In a method of winding wire having a free end onto a core having a central opening including the steps of forming the wire into a coil having a plurality of generally circular loops through the core's opening, each loop being formed in sequence about the coil's central axis radially inwardly of the loops previously formed so the coil has a thickness along this axis of less than two wire diameters and thereafter winding the wire onto the core by circulating the loops through the core's opening about the coil's axis, the improvement comprising; the steps of providing a continuous wire supply, feeding a portion of the wire with its free end leading the way, from the supply into a coil of loops through the core's opening from a point which is radially inwardly of the loops in the coil, circulating the free end and the loops thus formed about the coil's axis through the core's opening during the wire feeding step and thereafter, when a coil of desired length has been formed through the core, winding the wire onto the core, while maintaining the free end of the wire free, by halting the feeding of wire from the remaining supply while continuing to circulate the loops in the coil about the coil's axis through the core's opening.

2. A method according to claim 1 wherein the improvement comprises forming the loops in the coil so the coil has a thickness along its axis of from between about 1.25 to about 1.4 wire diameters.

3. In a method according to claim 1 the improvement comprising the step of circulating the loops about the coil's axis through the core's opening during the wire feeding step, at an angular velocity which is no less than that of the radially outermost loop.

4. In a method according to claim 1 the improvement comprising the step of circulating all the loops in the coil about the coil's axis at the same angular velocity during the wire feeding step.

5. In a method according to claim 1, the improvement comprising the steps of circulating the radially inner loops about the coil's axis through the core at an angular velocity which is no less than that of the radially outermost loop during both feeding and winding.

6. In a method according to claim 1 the improvement comprising the step of cutting the wire coil from the wire supply at a point between the supply and the coil after at least one turn of the wire from the coil has been wound around and tightened onto the core.

7. In a method according to claim 6 the improvement comprising the step of circulating the loops at the same angular velocity during both the feeding and the winding steps.

8. In a method according to claim 1 the improvement including the step of precurving the wire as it is fed from the supply to a curvature which is less than that of the first loop before that loop is formed.

9. A method of winding turns of wire onto a core wherein the improvement comprises the steps of: providing a continuous wire source, feeding a length of wire having a free end along its length from the source, guiding the leading free end of the wire to form a first circular loop through the core's opening as the wire is fed, forming additional circular loops through this opening from the wire being fed, each radially inwardly of the loop formed before it, circulating the wire's free end and each loop formed through the core's opening while the feeding step continues until a coil totaling the desired length of wire has been formed and thereafter while maintaining the free end of the wire free, winding the coil onto the core by halting the feeding of the wire from the remaining source while continuing to circulate the loops in the coil, and the wire's free end, through the core's opening.

10. A method according to claim 9 wherein the improvement comprises forming the loops in the coil so the coil has a thickness along its axis of from between about 1.25 to about 1.4 wire diameters.

11. The improvement according to claim 9 including the step of precurving the wire as it is fed from the source and before the loops are formed, to a curvature which is less than that of the radially outermost loop.

12. The improvement according to claim 9 including the step of circulating the loops in the coil about the coil's central axis in a predetermined direction and at the same angular velocity to wind the wire onto the core.

13. The improvement according to claim 9 which includes the step of severing the wire coil from the wire source after at least one turn of wire from the coil has been wound around and tightened onto the core.

14. The improvement according to claim 11 which includes the step of severing the wire coil from the wire source after at least one turn of wire from the coil has been wound around and tightened onto the core.

15. The improvement according to claim 9 including the step of circulating the loops in the coil about the coil's central axis in a predetermined direction and at the same angular velocity to wind the wire onto the core.

16. The improvement according to claim 1 including the step of forming adjacent loops in the coil from different wires.

17. A method of providing a core with a bifilar wire winding in which each succeeding turn on the core is a different wire comprising the steps of forming two lengths of wire into a single radial layer of double loops comprising a circular coil through the aperture of the core and winding the coil into a plurality of turns on the core wherein the step of forming the coil through the core's aperture comprises simultaneously feeding two different wires side by side along their lengths from a position inwardly of the radial boundary of a circular channel and out of the plane of the channel, into and along the channel until the first double wire loop is formed and thereafter advancing both wires further around the channel forcing their noses between the loop just formed and the radial boundary causing each successive double loop to form radially inwardly of its predecessor.

18. The improvement according to claim 9 characterized by the steps of sequentially feeding at least two wires along their lengths from separate sources into generally circular loops through the core's opening one radially inwardly of another with their leading ends staggered at least about 45° apart from the leading end of adjacent wires, the wires being fed from points radially inwardly of the coil, continuing the feeding of all wires until the desired number of loops have been formed and thereafter, while continuing to circulate the wires through the core's opening around the coil's central axis, winding the wires onto the core by continuing to circulate the wires while sequentially halting the feeding of the wires in staggered sequence at least about 45° of circulation apart in the order of their radial distance from the central axis of the coil beginning with the radially innermost loop in the coil.

19. A method according to claim 18 including the step of precurving each wire to a curvature which is less than that of the loops in the coil before the first loop is formed.

20. A method according to claim 18 including the step of severing each wire from its source after the first turn of that wire has been wound around and tightened onto the core.

* * * * *